US005163369A

United States Patent [19]

Hawitt

[11] Patent Number: 5,163,369

[45] Date of Patent: Nov. 17, 1992

[54] NON-CONTACT WEB CLEANING APPARATUS

[75] Inventor: Peter R. Hawitt, Haydock, England

[73] Assignee: J. & C. Moores, Ltd., Liverpool, England

[21] Appl. No.: 776,606

[22] Filed: Oct. 10, 1991

[30] Foreign Application Priority Data

Oct. 10, 1990 [GB] United Kingdom ..... 9022063

[51] Int. Cl.[5] ..... B41F 35/00; B41L 41/00

[52] U.S. Cl. ..... 101/423; 101/425

[58] Field of Search ..... 101/423, 424, 424.1, 101/425; 15/309.1; 34/114, 160

[56] References Cited

U.S. PATENT DOCUMENTS

| | | | |
|---|---|---|---|
| 2,082,411 | 6/1937 | Merrill | 101/423 |
| 2,818,595 | 1/1958 | Rosewall | 15/309.1 |
| 3,659,526 | 5/1972 | Staller | 101/425 |
| 3,956,790 | 5/1976 | Ishiwata et al. | 15/309.1 |
| 4,861,178 | 8/1989 | Reed | 101/424.1 |
| 4,906,333 | 3/1990 | Myren | 15/309.1 |

FOREIGN PATENT DOCUMENTS

| | | | |
|---|---|---|---|
| 291920 | 6/1928 | United Kingdom . | |
| 1244263 | 8/1971 | United Kingdom | 101/423 |

*Primary Examiner*—Edgar S. Burr

*Assistant Examiner*—Lynn D. Hendrickson

*Attorney, Agent, or Firm*—Knobbe, Martens, Olson & Bear

[57] ABSTRACT

A non-contact web cleaning apparatus has a pair of guide rollers over and under which a paper web is run and two cleaning heads, each for cleaning a respective one of the two opposite sides of the moving paper web. Each cleaning head has a pressure slot for directing compressed air against the moving paper web as it passes around a respective one of the guide rollers and a vacuum slot for carrying away particles dislodged from the paper web by the pressure slot flow. The two cleaning heads are pivotally mounted about fixed axis so as to be displaceable relative to the guide rollers, and hence to the path of the paper web, between first positions in which the heads are disposed in their operational positions relative to the guide rollers for cleaning the paper web and second positions in which the heads are spaced sufficiently far from the guide rollers to facilitate feeding of the paper web therebetween. Abutment members automatically set the spacing between the cleaning heads and the respective guide rollers to achieve said first positions by engagement of tubes in the cleaning heads with the abutment members. A double acting ram displaces the cleaning heads between their two positions by acting between two pivotable arms on which the cleaning heads are mounted.

9 Claims, 2 Drawing Sheets

NON-CONTACT WEB CLEANING APPARATUS

The present invention relates to a non-contact cleaning apparatus for moving paper webs.

Printing on, for example, less costly paper having a high content of lint can often result in a deterioration in the printing quality. Furthermore, particles of lint tend to be circulated through the machinery, which then has to be stopped and cleaned with solvents. It is thus necessary to provide some means of removing the lint from the web, in such a manner that it is prevented as far as possible from entering the machinery.

There exists a technique of using ultrasound in the form of high frequency (20–100 kHz) pressure waves to penetrate the boundary layer of air next to the web surface which is to be cleaned. The machinery used comprises pressure and vacuum slot structures on a cleaning head, these slot structures being arranged to provide a balanced flow across the active width of the web. Two such cleaning heads are provided which are disposed conventionally in fixed positions, just above and just below the web, respectively, at or adjacent the upstream (input) end of the printing machinery. A particular problem with the very small clearance (of the order of 55 thousandths of an inch (1400 μm) between the web and the cleaning heads in this known apparatus is that it can be extremely difficult, if not impossible, to feed the paper web through the apparatus during initial setting up of a printing run.

It is an object of the present invention to provide a non-contact web cleaner, in which this problem is overcome.

In accordance with the present invention, there is provided a non-contact web cleaning apparatus comprising a pair of guide rollers over and under which a paper web is run in use of the apparatus, two cleaning heads, each for cleaning a respective one of the two opposite sides of the moving paper web, each cleaning head having a pressure slot adapted to direct compressed air against the moving paper web as it passes around a respective one of the guide rollers and a vacuum slot for carrying away particles dislodged from the paper web by the pressure slot flow, the two cleaning heads being pivotally mounted so as to be selectively displaceable relative to the guide rollers, and hence to the paper web path between first positions in which the heads are disposed in their operational positions relative to the guide rollers for cleaning said paper web and second positions in which the heads are spaced further from the guide rollers to facilitate feeding of the paper web therebetween, and abutment means for automatically setting the spacing between the cleaning heads and the respective guide rollers to achieve said first positions.

Preferably, the abutment means are adapted to engage the respective cleaning heads to define said first positions of the cleaning heads.

The abutment means can comprise a pair of fixed, non-rotating members disposed at the outboard ends of the associated guide roller and of radial dimension greater than that of that guide roller.

Preferably, said fixed, non-rotating members are cylindrical and are at diameter greater than that of the associated guide roller.

Each of said cylindrical members can also define a bearing housing for respective bearings by which the associated guide roller is journalled for rotation.

In a preferred embodiment, the pressure and vacuum slots in each cleaning head are defined within respective tubes extending parallel to the guide rollers, said first position of the cleaning heads being defined by the engagement of said tubes with said abutment means.

Preferably, each of the two cleaning heads is attached rigidly to a respective arm which can pivot about a respective fixed axis parallel to the axis of rotation of the guide rollers, the two arms being interconnected intermediate their ends by means of a double acting ram.

Advantageously, a fixed stop is disposed to engage one of the cleaning heads when in its second position.

It is preferred that, in the case of each arm, the pivoting axis of that arm, which carries the cleaning head associated with one of the guide rollers, is coincident with the axis of rotation of the other guide roller of said pair.

By way of example only, a specific embodiment of the present invention will now be described with reference to the accompanying drawings, in which.

Figure 1:
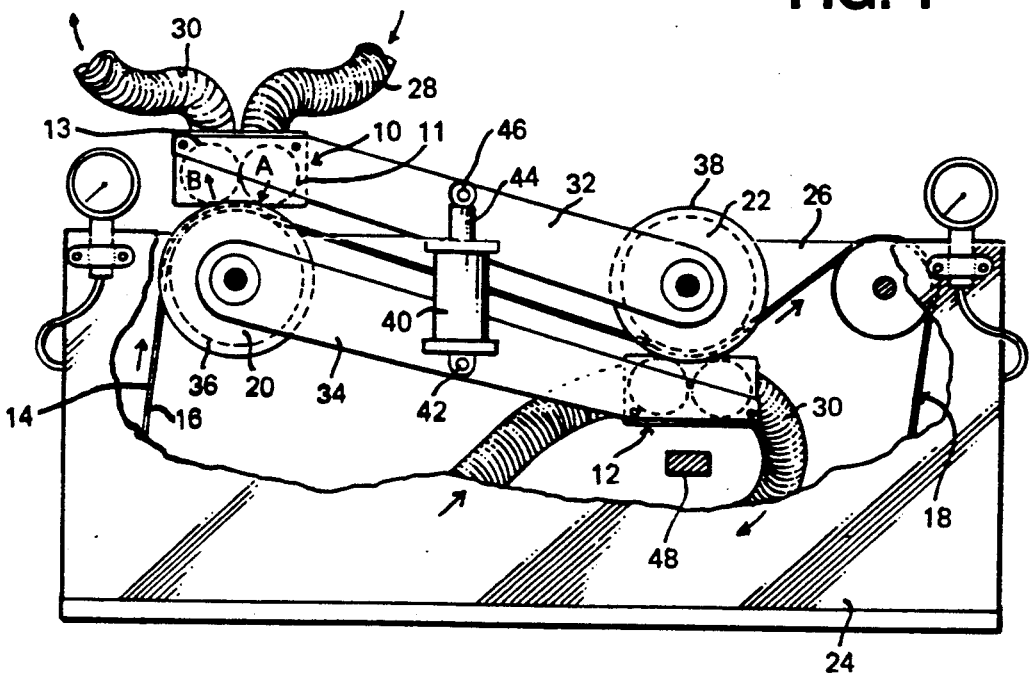
FIG. 1 is a diagrammatic cross-section through a non-contact web cleaner in accordance with the present invention in its operational position.

The non-contact web cleaning apparatus illustrated in the drawings comprises two pneumatically adjustable cleaning heads 10, 12 for cleaning the two opposite surfaces 14, 16, respectively, of a web of paper 18 which is guided through the apparatus on freely rotatable rollers 20 and 22 journalled between two fixed, parallel side plates 24, 26 of the apparatus.

Figure 2:
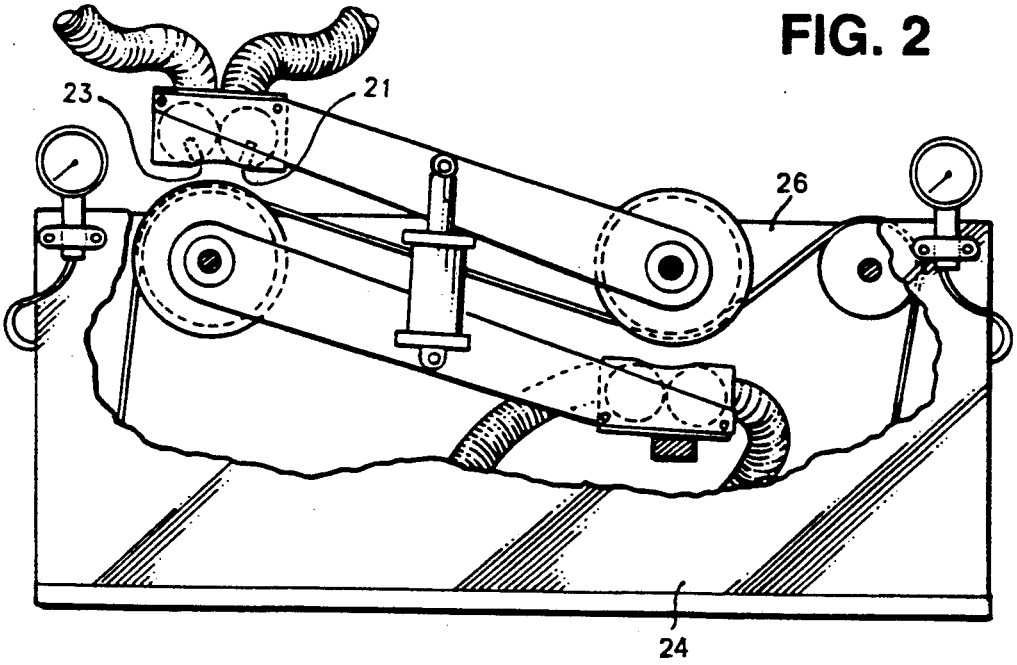
FIG. 2 is a cross-section through the non-contact web cleaner in FIG. 1 in its non-operational position.

Each cleaning head 10, 12 includes a pair of tubes 11, 13 of generally circular section which define respectively a pressure slot 21 and a vacuum slot 23 (shown in FIG. 2) which extend longitudinally of the cleaning head but transversely in relation to the direction of passage of the paper web 18 through the apparatus. The tube 11 with the slot 21 and the tube 13 with the slot 23 define a pressure device and an vacuum device, respectively. The tube 11 defining the pressure slot is connected to a source of compressed air via flexible pipework 28 and the tube 13 defining the vacuum slot is connected to a partial vacuum via flexible pipework 30. The pressure slot is disposed downstream of the vacuum slot in relation to the direction of movement of the paper web and is angled so as to direct air at the paper web, against the direction of movement of the paper, the vacuum slot being positioned so as to pick up particles of lint and dust dislodged from the web by the pressurised air. The direction of the pressurised air supplied by the pressure slot is indicated in FIG. 1 by the arrow A, this air (and any dust or lint carried thereby) entering the vacuum slot approximately in the direction indicated by arrow B in FIG. 1.

The opposite ends of the cleaning head 10 are rigidly connected to the one ends of a pair of first arms 32, the other ends of the first arms 32 being freely pivotable about an axis which is coincident with the axis of rotation of the guide roller 22 between the side plates 24, 26. Likewise, the opposite ends of the other cleaning head 12 are rigidly connected to the one ends of a pair of second arms 34, the other ends of the second arms 34 being freely pivotable about an axis which is coincident with the axis of rotation of the guide roller 20 between the side plates 24, 26.

Thus, the two heads 10, 12 can pivot about the fixed axis of rotation of the guide rollers 22, 20 respectively, whereby to lift the head 10 away from the roller 20 and hence from the paper web carried thereby and to lower the head 12 away from the roller 22 and hence again from the paper web.

Figure 3:
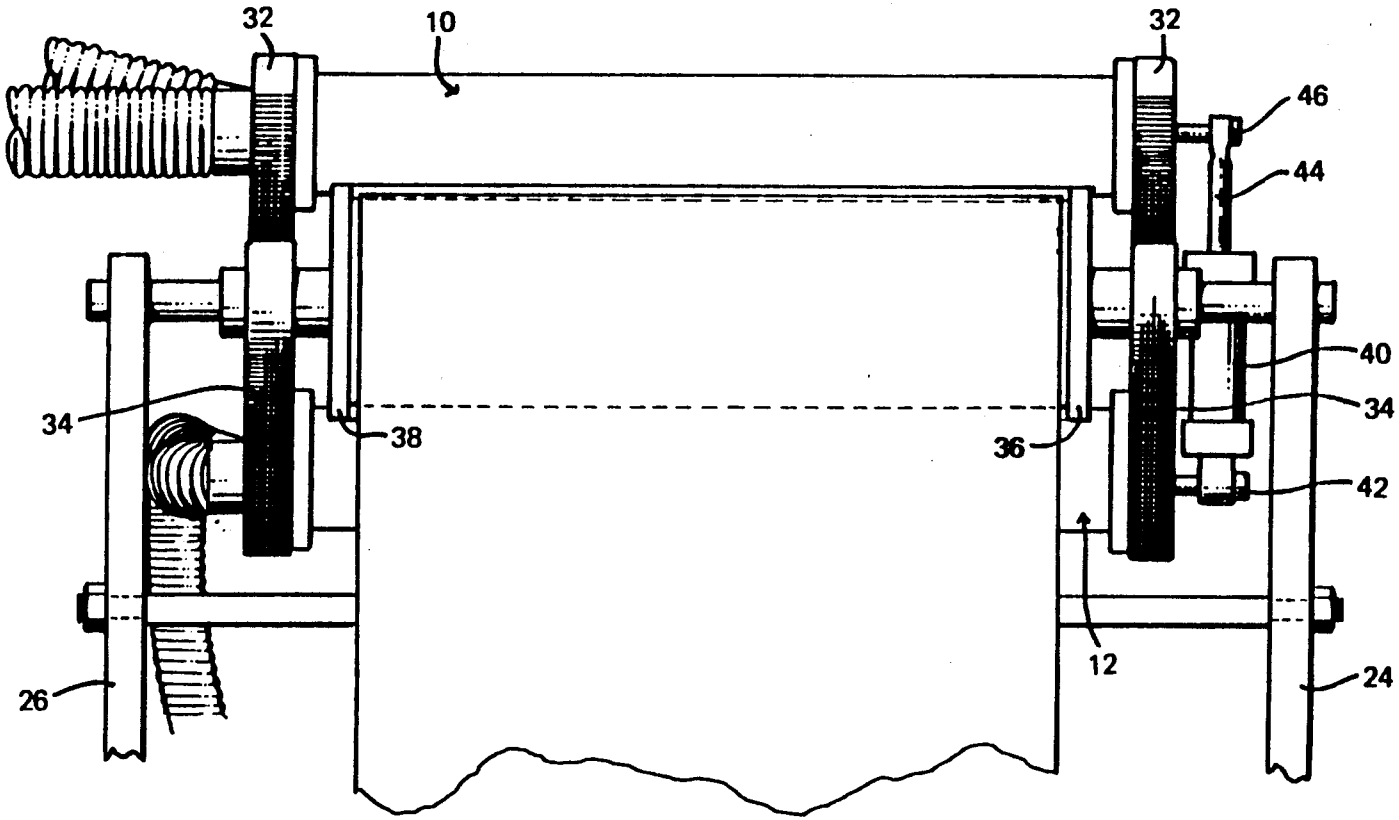
FIG. 3 is a partial end view of the non-contact web cleaner of FIGS. 1 and 2.

Disposed outboard of the two ends of each of the guide rollers 20, 22 is a respective pair of fixed abutment members 36, 38. In this embodiment, the abutment members 36, 38 each have a cylindrical outer casing which houses parts or all of the bearings (not shown) by which the guide rollers 20, 22 are journalled. As is evident from the drawings, particularly FIG. 3, the external diameter of the abutment members 36, 38 is slightly greater than that of the guide rollers 20, 22 themselves, by the amount that it is required to space the tubes 11, 13 of the cleaning heads from the guide rollers 20, 22 and hence from the paper web where it passes over these rollers. Preferably, this clearance is of the order of fifty-five thousandths of an inch (1400 μm). Thus, in the operational position of the heads 10, 12 shown in FIGS. 1 and 3, with the heads 10, 12 engaged against the respective abutment members 38, the spacings between the pressure and vacuum slots on the heads 10, 12 and the two opposite sides of the paper web are automatically set at the required amount.

For displacing the heads to a non-operational position, the body of a pneumatic double acting ram 40 is pivotally connected to the arm 34 at 42, the piston 44 of the ram 40 being pivotally connected to the arm 32 at 46. A similar ram arrangement can if necessary be mounted between the arms 32, 34 at the other side of the apparatus and operated in tandem (parallel) with the ram 40. Disposed beneath the head 12 is a fixed stop 48.

When it is desired to displace the heads 10, 12 to a non-operational position in which they are spaced from the web path by a sufficient distance to enable the web to be inserted easily through the apparatus for setting up purposes, the pneumatic ram (or rams) 40 is activated in a direction to extend the piston 44. As a result of the effect of gravity acting on the head 10 and arm 32, the piston 44 is urged downwardly so that, upon compressed air being supplied to the ram, the first result is that the ram body moves downwardly, taking with it the arm 34 and head 12. The head 12 is thereby moved away from the roller 22 and hence from the web path. The head 12 continues to be lowered until it engages the stop 48, which is fixed relative to the side plates 24, 26. Thereafter, continued energisation of the ram 40 causes the arm 32 to be raised about its pivoting axis and therefore the head 10 to be raised from the guide roller and hence from the web path. The maximum displacement of the head 10 occurs when the ram 40 has been fully extended. In this condition, shown in FIG. 2, both heads are separated from the web path sufficiently to enable the paper web to be introduced easily and quickly through the apparatus.

When thereafter the pneumatic ram is energised in a direction to withdraw the piston into the ram body, the latter operation is reversed. The head 10 is first lowered onto the abutment member 36 associated with the guide roller 20 and the head 12 is then raised up to engagement with the abutment member 36 associated with the guide roller 22. As a result of the construction described hereinbefore, engagement of the heads 10, 12 with the abutment members is arranged automatically to achieve the required precision spacing between the tubes 11, 13 of the heads and the rollers (and hence between the pressure and vacuum slots and the paper web).

By virtue of the aforegoing structure, the web cleaner of the present invention is provided with pneumatically adjustable cleaning heads which can be selectively disposed at close proximity with the web, or removed sufficiently far away to facilitate easy loading of paper onto the rollers.

We claim:

1. A non-contact web cleaning apparatus comprising:

a pair of rotatable guide rollers over and under which a paper web is run in use of the apparatus;

two cleaning heads, each for cleaning a respective one of the two opposite sides of the moving paper web;

each cleaning head having a pressure device adapted to direct compressed air against the moving paper web as it passes around a respective one of the guide rollers and a vacuum device for carrying away particles dislodged from the paper web by the pressure device flow;

the two cleaning heads being pivotably mounted so as to be selectively displaceable relative to the guide rollers, and hence to the paper web path, between first positions in which the heads are disposed in their operational positions relative to the guide rollers for cleaning said paper web and second positions in which the heads are spaced further from the guide rollers to facilitate feeding of the paper web therebetween; and abutment means for automatically setting the spacing between the cleaning heads and the respective guide rollers to achieve said first positions, the abutment means being adapted to engage the respective cleaning heads to define said first positions of the cleaning heads, and each abutment means comprising a pair of members disposed at the outboard ends of the associated guide roller, said members having radial dimension, considered relative to the rotational axis of the associated guide roller, greater than that of that guide roller.

2. An apparatus as claimed in claim 1 wherein said members are cylindrical and are of diameter greater than that of the associated guide roller.

3. An apparatus as claimed in claim 2 wherein each of said cylindrical members also defines a bearing housing for respective bearings by which the associated guide roller is journalled for rotation.

4. An apparatus as claimed in claim 1, 2 or 3, wherein the pressure and vacuum devices in each cleaning head are defined within respective tubes extending parallel to the guide rollers, said first position of the cleaning heads being defined by the engagement of said tubes with said abutment means.

5. An apparatus as claimed in claim 1, wherein each of the two cleaning heads is attached rigidly to a respective arm which can pivot about a respective fixed axis parallel to the axis of rotation of the guide rollers, the two arms being interconnected intermediate their ends by means of a double acting ram.

6. An apparatus as claimed in claim 5, further including a fixed stop disposed to engage one of the cleaning heads when in its second position.

7. An apparatus as claimed in claim 6, wherein, in the case of each arm, the pivoting axis of that arm, which carries the cleaning head associated with one of the guide rollers, is coincident with the axis of rotation of the other guide roller of said pair.

8. An apparatus as claimed in claim 5, 6 or 7 in which each cleaning head is connected to a pair of said arms, disposed at the opposite ends of that cleaning head respectively.

9. A non-contact web cleaning apparatus comprising:

a pair of rotatable guide rollers over and under which a paper web is run in use of the apparatus;

two cleaning heads, each for cleaning a respective one of the two opposite sides of the moving paper web;

each cleaning head having a pressure device adapted to direct compressed air against the moving paper web as it passes around a respective one of the guide rollers and a vacuum device for carrying away particles dislodged from the paper web by the pressure device flow;

the two cleaning heads being pivotably mounted so as to be selectively deplaceable relative to the guide rollers, and hence to the paper web path, between first positions in which the heads are disposed in their operational positions relative to the guide rollers for cleaning said paper web and second positions in which the heads are spaced further from the guide rollers to facilitate feeding of the paper web therebetween; and, abutment means for automatically setting the spacing between the cleaning heads and the respective guide rollers to achieve said first positions, the abutment means being adapted to engage the respective cleaning heads to define said first positions of the cleaning heads, and each abutment means comprising a pair of fixed, non-rotating members disposed at the outboard ends of the associated guide roller of radial dimension, considered relative to the rotational axis of the associated guide roller, greater than that of that guide roller.

* * * * *